US009808736B2

(12) United States Patent
Su

(10) Patent No.: US 9,808,736 B2
(45) Date of Patent: Nov. 7, 2017

(54) COLLAPSIBLE TOY STRUCTURES

(71) Applicant: Kenyield International Group Ltd., Kowloon (HK)

(72) Inventor: Ku-Fong Su, Kowloon (HK)

(73) Assignee: Kenyield International Group Ltd., Hong Kong (HK)

( * ) Notice: Subject to any disclaimer, the term of this patent is extended or adjusted under 35 U.S.C. 154(b) by 0 days.

(21) Appl. No.: 14/990,991

(22) Filed: Jan. 8, 2016

(65) Prior Publication Data

US 2017/0197155 A1 Jul. 13, 2017

(51) Int. Cl.
*A63H 33/30* (2006.01)
*A63H 33/42* (2006.01)

(52) U.S. Cl.
CPC ..... *A63H 33/30* (2013.01); *A63H 33/3055* (2013.01); *A63H 33/3072* (2013.01); *A63H 33/42* (2013.01)

(58) Field of Classification Search
CPC ..... A63H 33/00; A63H 33/008; A63H 33/30; A63H 33/42; A63H 33/3055; A63H 33/3072; A47B 3/00; A47B 3/002; A47B 3/08
See application file for complete search history.

(56) References Cited

U.S. PATENT DOCUMENTS 1,133,109 A * 3/1915 Derbyshire ..... A47B 3/0912 108/132
3,346,317 A * 10/1967 Peggs ..... A47F 5/108 108/100
4,515,359 A * 5/1985 Mariol ..... A63H 3/52 108/33
6,811,233 B1 * 11/2004 Packer ..... B25H 1/04 108/176
8,568,194 B2 * 10/2013 Fein ..... A63H 33/3055 446/147
8,601,956 B2 * 12/2013 Ceballos-Godefroy ..... A47B 3/00 108/134
2008/0149006 A1 * 6/2008 Leng ..... A47B 13/08 108/121
2011/0266846 A1 * 11/2011 Dixon ..... A47D 11/005 297/217.1
2012/0225605 A1 * 9/2012 Fein ..... A63H 33/3055 446/481

* cited by examiner

*Primary Examiner* — Gene Kim
*Assistant Examiner* — Alyssa Hylinski
(74) *Attorney, Agent, or Firm* — Raymond Sun

(57) ABSTRACT

A collapsible toy structure has a back support, a counter top pivotably connected to the back support, a front wall that is pivotably connected to underside of the counter top, a locking mechanism having a block secured to the back support and a locking bar rotatably connected to the block, a left side wall having a left front panel, and a right side wall having a right front panel. The toy structure assumes a collapsed position with the counter top pivoted to an upright position against the back support, the front wall pivoted to an upright position against the counter top, the left front panel and the right front panel pivoted against the front wall, and with the locking bar rotated to a position where its opposite ends are positioned against the left front panel and the right front panel.

6 Claims, 10 Drawing Sheets

COLLAPSIBLE TOY STRUCTURES

BACKGROUND OF THE INVENTION

1. Field of the Invention

The present invention relates to toys, and more particularly to larger toy structures, such as kitchens and workbenches, that may be collapsed, such as for storage 2. Description of the Prior Art Life-size toy structures have become popular with children as they allow a child to re-create a real-life experience with a toy structure. Good examples include toy kitchens and toy workbenches that are now being made of a larger size so that a child can play with these structures as if the structure were a real kitchen or workbench.

Unfortunately, these larger toy structures consume significant space. Because of their size, many such toy structures cannot be stored as assembled in narrow or small areas, such as under beds or in some closets. Therefore, the toy structures may have to be partially disassembled into parts small enough to store in those areas. However, such disassembly (and subsequent assembly) may be time-consuming and parts of the toy kitchen may be lost during the storage process.

Therefore, there may be a need for toy structures, such as kitchens and workbenches, that may be quickly collapsed for storage in narrow or small areas without removal of numerous parts. There is also a need for toy structures that may likewise be quickly redeployed to its expanded position for use.

SUMMARY OF THE DISCLOSURE

In order to accomplish the objects of the present invention, there is provided a collapsible toy structure comprising a back support, a counter top pivotably connected to the back support, and a front wall that is pivotably connected to underside of the counter top. A locking mechanism has a block coupled to the back support and a locking bar rotatably connected to the block. The structure also has a left side wall having a left rear panel and a left front panel, the left rear panel having a rear edge that is secured is the left edge of the back support, and a front edge that is pivotably connected to the left front panel. The structure further includes a right side wall having a right rear panel and a right front panel, the right rear panel having a rear edge that is secured is the right edge of the back support, and a front edge that is pivotably connected to the right front panel. The toy structure assumes a collapsed position with the counter top pivoted to an upright position against the back support, the front wall pivoted to an upright position against the counter top, the left front panel and the right front panel pivoted against the front wall, and with the locking bar rotated to a position where its opposite ends are positioned against the left front panel and the right front panel.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

Figure 1:
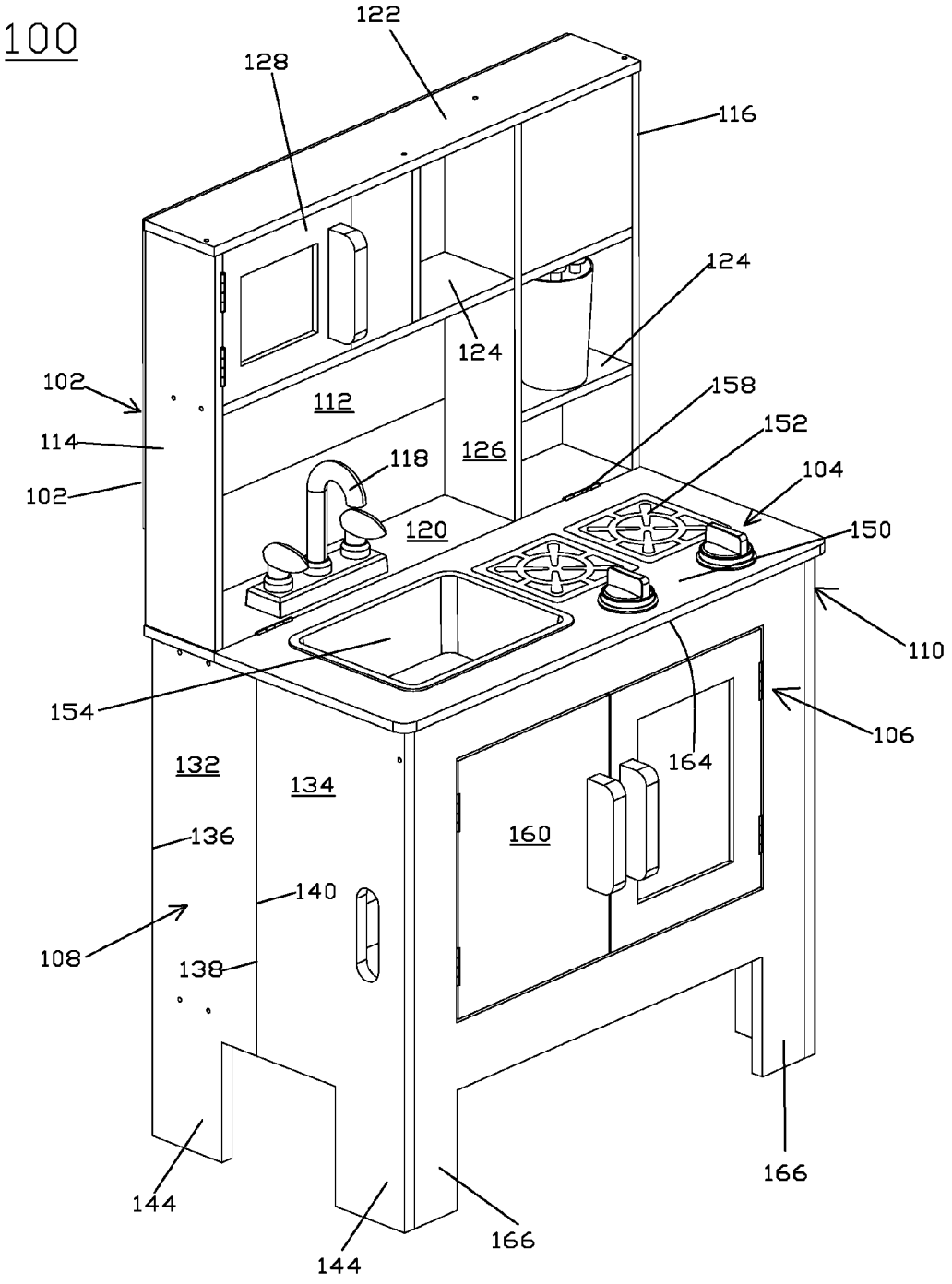
FIG. 1 is a perspective view of a collapsible toy kitchen according to one embodiment of the present invention.
Figure 2:
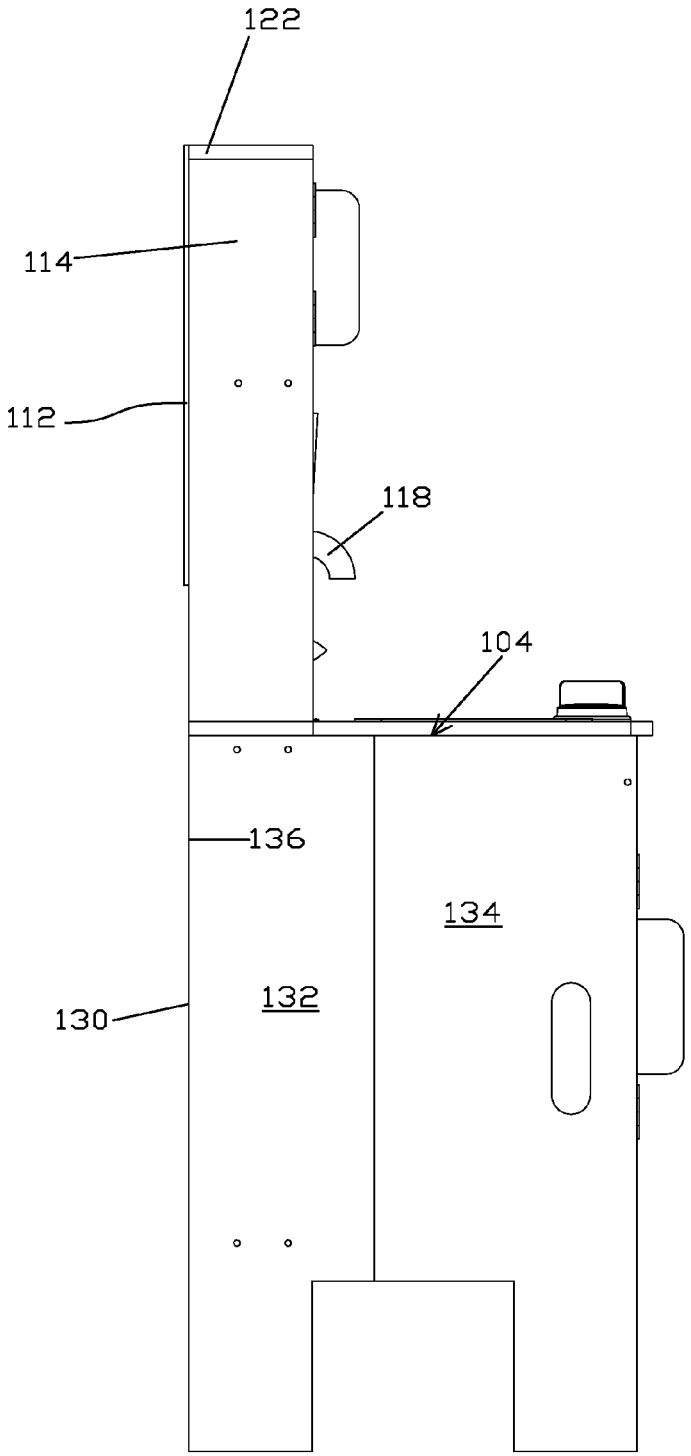
FIG. 2 is a left side view of the kitchen of FIG. 1.

FIGS. 1 and 2 illustrate a collapsible toy kitchen 100 according to an embodiment of the present invention. The collapsible toy kitchen 100 is shown in FIG. 1 in the expanded position, for use. The collapsible toy kitchen 100 may include a back support 102, a kitchen counter 104, a front wall 106 and two side walls 108 and 110.

Figure 6B:
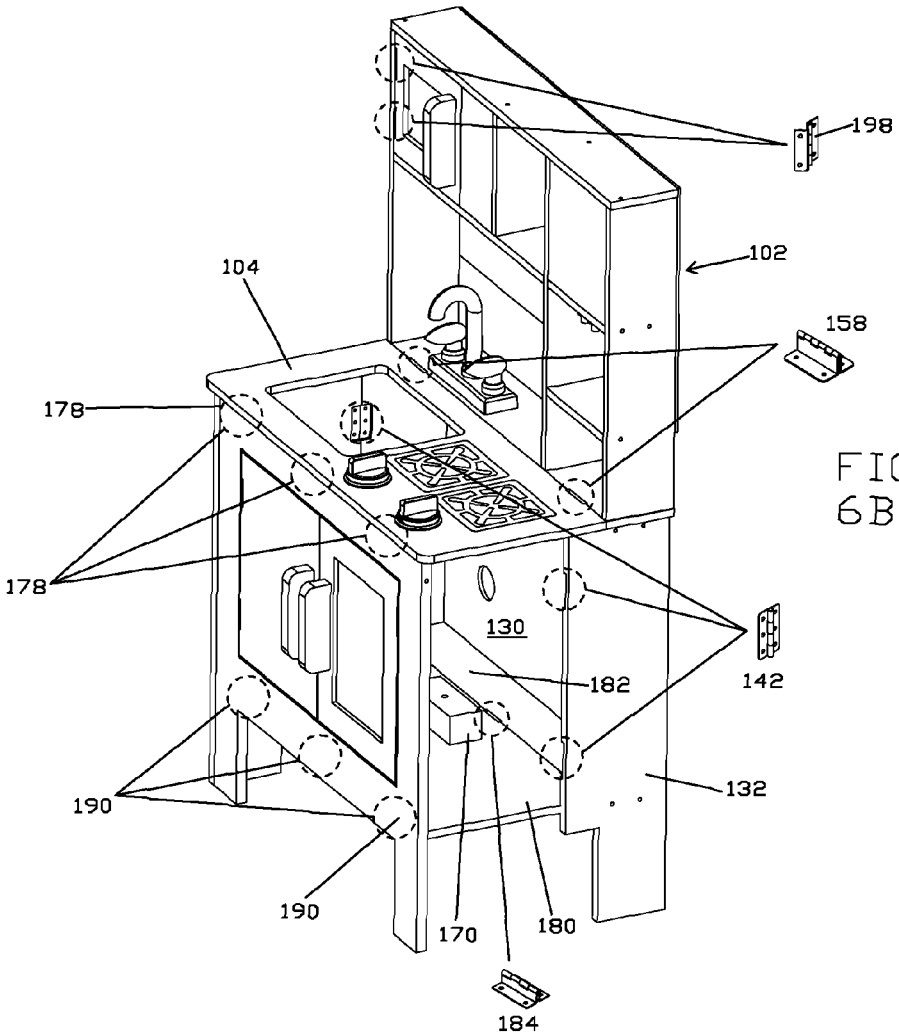
FIG. 6B illustrates the same kitchen of FIG. 6A but with a part of the side wall removed to illustrate the internal components.

The back support 102 may include a back wall 112 and a lower back support 130. The back wall 112 and lower back support 130 can be provided in one piece, or they can be separated. The back wall 112, two side walls 114 and 116, a horizontal panel 120 and a top wall 122 together enclose and define an interior space that can be further divided up by shelving panels 124 and dividing walls 126. All of these walls and panels 114, 116, 120, 122, 124 and 126 are attached to the back wall 112. A faucet 118 can be connected to the horizontal panel 120, and optional doors 128 can be hingedly connected (e.g., via hinges 198 as shown in FIG. 6B) to certain dividing walls 126 or side walls 114, 116 to enclose storage areas.

Each side wall 108 and 110 can be provided in two separate pieces that can be hingedly or pivotably connected to each other. Specifically, each side wall 108, 110 has a rear panel 132 and a front panel 134. The rear edge 136 of the rear panel 132 can be fixedly attached to a side edge of the lower back support 130. The front edge 138 of the rear panel 132 and the rear edge 140 of the front panel 134 can be hingedly connected (e.g., via hinges 142 as shown in FIGS. 3-5 and 6B) to each other. Legs 144 can be defined at the bottom of the panels 132 and 134.

The kitchen counter 104 can include a countertop 150 and one or more kitchen components. The kitchen components may be positioned on and/or extend through the countertop 150, and can include a range 152 connected to the countertop 150, and a sink 154 extending through the countertop 150. The faucet 118, range 152 and sink 154, as well as other elements of the toy kitchen may be considered toys and thus not be "operational" as their real counterparts, though in another embodiment one or more of those elements may actually be operational to a limited extent to simulate real play.

The kitchen counter 104 may be pivotably connected to the back wall 112 or other part of the back support 102, as desired. In one such embodiment, a rear edge of the kitchen counter 104 is pivotably connected (e.g., via hinges 158) to the horizontal panel 120.

The front wall 106 includes a wall portion with two doors 160 hingedly connected (e.g., via hinges) thereto. The upper edge 162 (see FIG. 3) of the front wall 106 is pivotably connected via hinges 178 (see FIG. 6B) to the underside of the kitchen counter 104 at a location that is offset from the front edge 164 of the kitchen counter 104. Legs 166 can be defined at the bottom of the front wall 106.

Referring to FIGS. 3-5 and 6B, a lower horizontal panel 180 is hingedly connected at its rear edge via hinges 184 to another horizontal panel 182 that extends from the lower back support 130. The front edge of the panel 180 is hingedly connected to the interior surface of the front wall 106 via hinges 190. A locking mechanism is provided on the panel 180. The locking mechanism includes a stationary mounting block 170 that is securely mounted to the panel 180, and a pivoting bar 172 pivotably secured to the front of the block 170. The depth of the block 170 is dimensioned so that it is slightly larger than the width of the rear panels 132, so as to allow the bar 172 to snugly overlie the outsides of the front panels 134 after they have been folded towards each other in the collapsed position.

Figure 7:
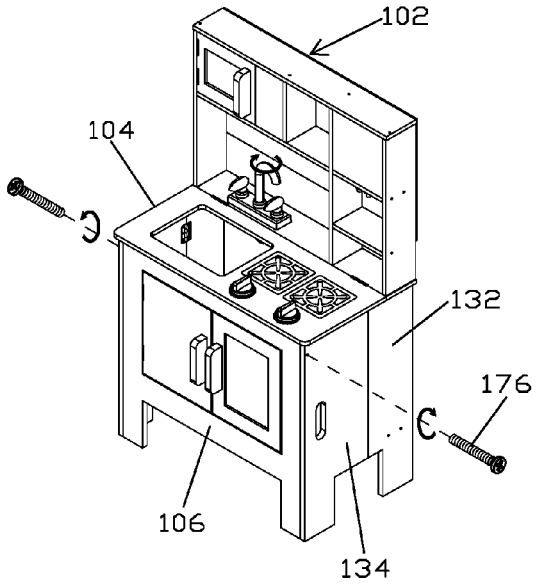
Figure 8:
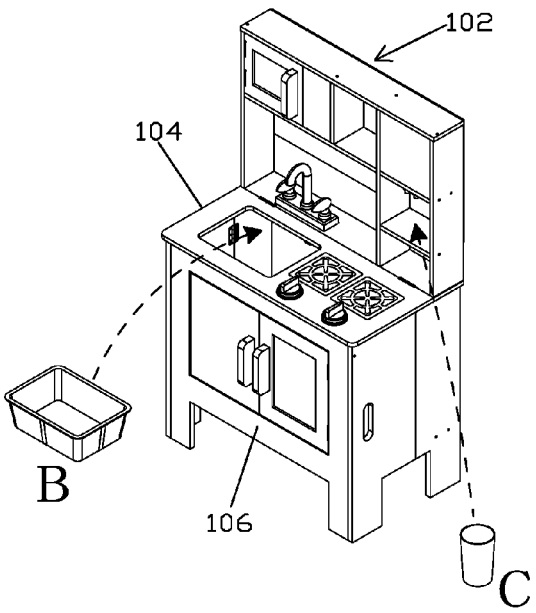

In addition, referring to FIG. 7, the front panels 134 can be secured to the front wall 106 via threaded connections by the use of screws 176.

Figure 3A:
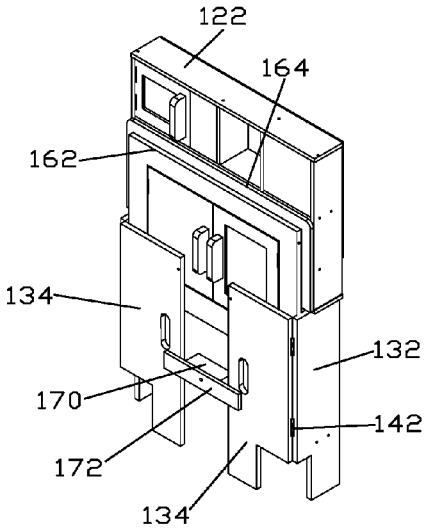
FIG. 3A shows the kitchen of FIG. 1 in the fully collapsed position.
Figure 4:
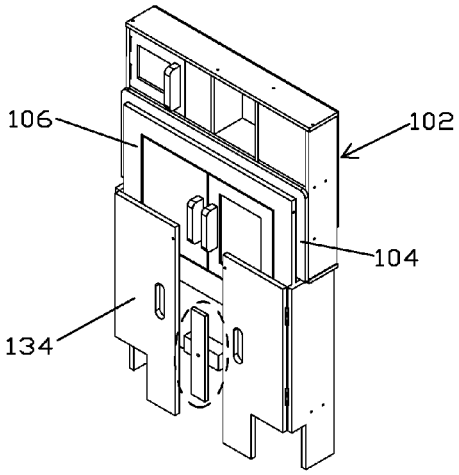
FIGS. 4, 5, 6A, 7 and 8 illustrate the steps for deploying the kitchen of FIG. 3 into a fully expanded position for use.
Figure 3B:
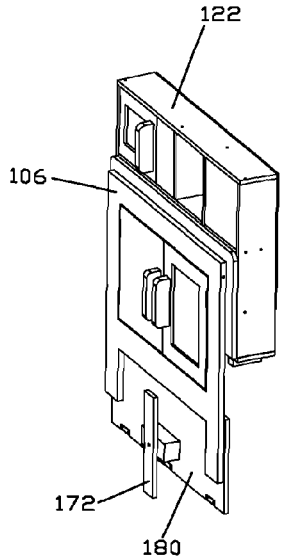
FIG. 3B illustrates the same kitchen of FIG. 3A but with some of the components removed.

FIGS. 3-8 illustrate how the kitchen 100 can be collapsed and deployed. Starting with FIGS. 1 and 8, the kitchen 100 is shown in the fully deployed position. Trays B and cups C can be removed from the storage compartments in the back support 102. In FIG. 7, the screws 176 can be removed, and then the front panels 134 can be pivoted away from each other (see FIGS. 5 and 6A), so as to allow the front wall 106 to be pushed upwardly about the pivoting connections (i) defined by the hinges 178 between the upper edge 162 of the front wall 106 and the underside of the kitchen counter 104, (ii) defined by the hinges 158 between the kitchen counter 104 and the panel 120, (iii) defined by the hinges 190 between the front edge of the panel 180 and the front wall 106, and (iv) defined by the hinges 184 between the rear edge of the panel 180 and the front edge of the panel 182. This allows the kitchen counter 104 to be pushed against the back board 102 (with the faucet 118 fitting inside the sink 154), and the front wall 106 to be pushed against the underside of the kitchen counter 104, with the panel 180 sandwiched between the front wall 106 and the lower back support 130, and positioned below the kitchen counter 104. Referring to FIG. 4, the front panels 134 can then be pivoted towards each other, and when the front panels 134 are resting against the front wall 106, the bar 172 can be rotated by ninety degrees so that its opposite ends are resting against the front panels 134 to secure the entire assembly in a collapsed and secure arrangement as shown in FIG. 3.

Figure 5:
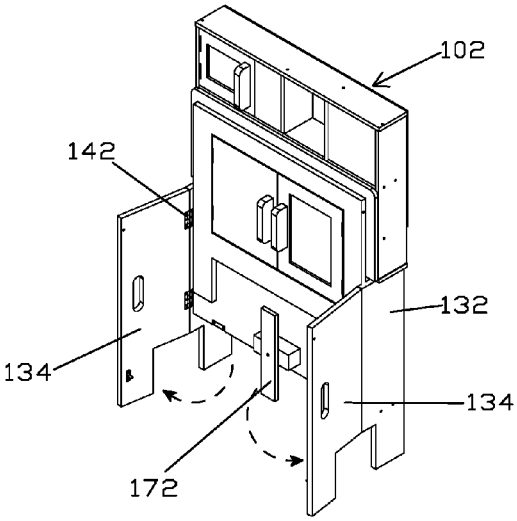
Figure 6A:
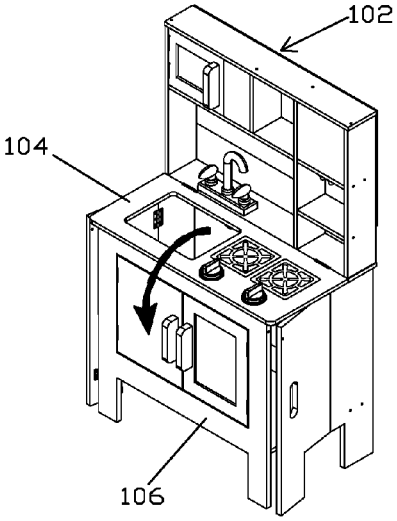

The kitchen 100 can be opened up and deployed by reversing the steps shown in FIGS. 3-8, by following the sequence of steps shown in FIGS. 3-8. First, the bar 172 is rotated by ninety degrees to free the front panels 134 (FIG. 4), which are then pivoted away from each other (FIG. 5). The front wall 106 is then pulled down (FIG. 6) so that the kitchen counter 104 is deployed. The front panels 134 are then secured to the front wall 106 via the screws 176 (FIG. 7) and then the components B and C are put into place and the kitchen 100 is ready for use.

FIGS. 9-15 illustrate a collapsible workbench 100*a* according to the present invention. The workbench 100*a* has a very similar construction as the kitchen 100, so the same numerals will be used to designate corresponding elements in both embodiments except an "a" is added to the designations in FIGS. 9-15.

Figure 9:
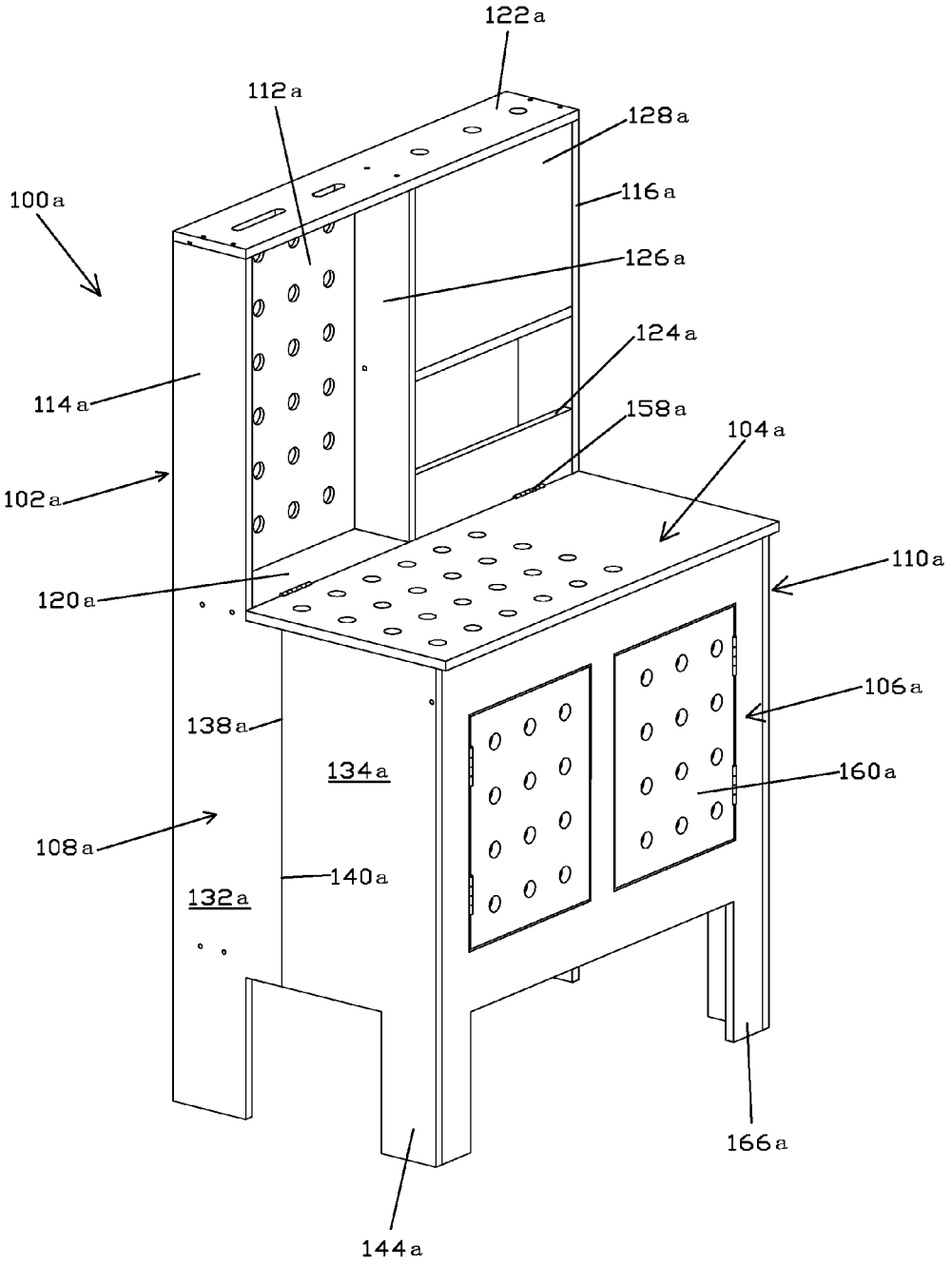
FIG. 9 is a perspective view of a collapsible toy workbench according to another embodiment of the present invention.
Figure 10:
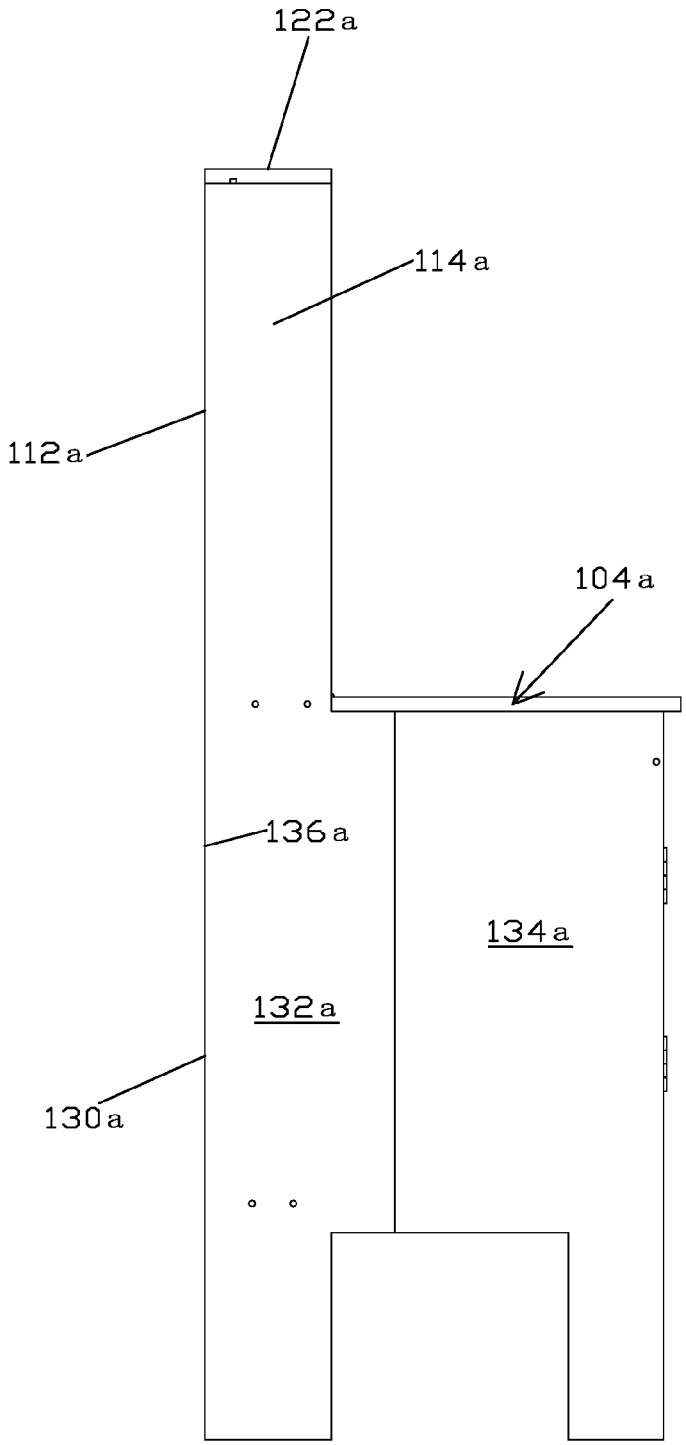
FIG. 10 is a left side view of the workbench of FIG. 9.

The collapsible workbench 100*a* is shown in FIG. 9 in the expanded position, for use. The collapsible workbench 100*a* may include a back support 102*a*, a counter top 104*a*, a front wall 106*a* and two side walls 108*a* and 110*a*.

The back support 102*a* may include a back wall 112*a* and a lower back support 130*a*. The back wall 112*a* and lower back support 130*a* can be provided in one piece, or they can be separated. The back wall 112*a*, two side walls 114*a* and 116*a*, a horizontal panel 120*a* and a top wall 122*a* together enclose and define an interior space that can be further divided up by shelving panels 124*a* and dividing walls 126*a*. All of these walls and panels 114*a*, 116*a*, 120*a*, 122*a*, 124*a* and 126*a* are attached to the back wall 112*a*. Optional doors 128*a* can be hingedly or otherwise connected to certain dividing walls 126*a* or side walls 114*a*, 116*a* to enclose storage areas.

Figure 13:
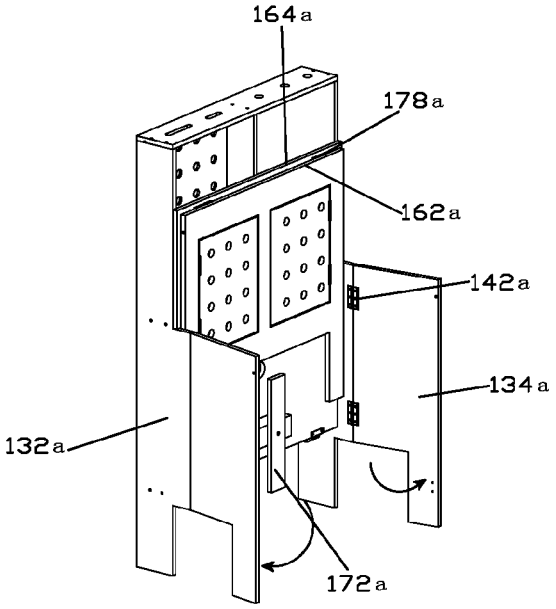
Figure 14A:
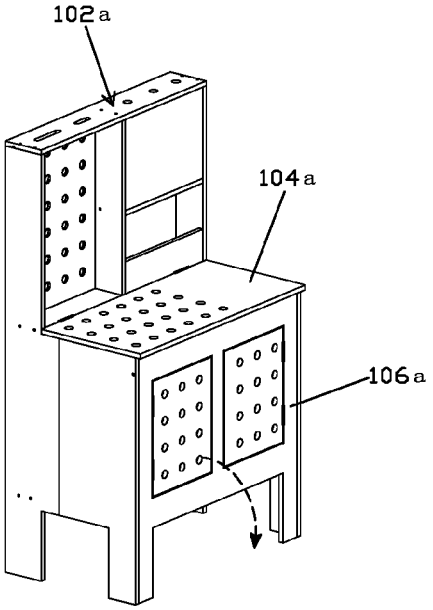
Figure 14B:
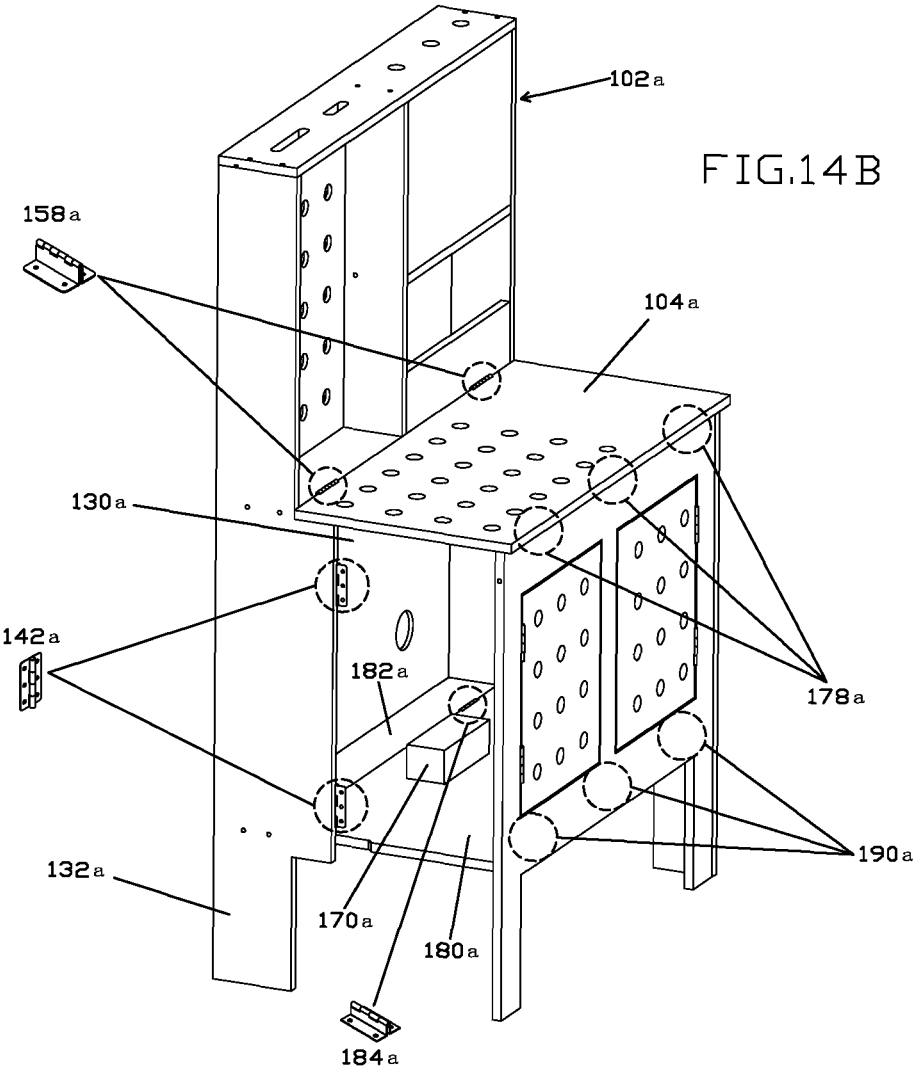
FIG. 14B illustrates the same kitchen of FIG. 14A but with a part of the side wall removed to illustrate the internal components.

Each side wall 108*a* and 110*a* can be provided in two separate pieces that can be hingedly or pivotably connected to each other. Specifically, each side wall 108*a*, 110*a* has a rear panel 132*a* and a front panel 134*a*. The rear edge 136*a* of the rear panel 132*a* can be fixedly attached to a side edge of the lower back support 130*a*. The front edge 138*a* of the rear panel 132*a* and the rear edge 140*a* of the front panel 134*a* can be hingedly connected (e.g., via hinges 142*a* as shown in FIG. 13 and FIG. 14B) to each other. Legs 144*a* can be defined at the bottom of the panels 132*a* and 134*a*.

The counter top 104*a* may be pivotably connected to the back wall 112*a* or other part of the back support 102*a*, as desired. In one such embodiment, a rear edge of the counter top 104*a* is pivotably connected (e.g., via hinges 158*a*) to the horizontal panel 120*a*.

The front wall 106*a* includes a wall portion with two doors 160*a* hingedly connected (e.g., via hinges) thereto. The upper edge 162*a* (see FIG. 13) of the front wall 106*a* is pivotably connected (e.g., via hinges 178*a*) to the underside of the counter top 104*a* at a location that is offset from the front edge 164*a* of the counter top 104*a*. Legs 166*a* can be defined at the bottom of the front wall 106*a*.

Referring to FIGS. 11-13 and 14B, a lower horizontal panel 180*a* is hingedly connected at its rear edge via hinges 184*a* to another horizontal panel 182*a* that extends from the lower back support 130*a*. The front edge of the panel 180*a* is hingedly connected to the interior surface of the front wall 106*a* via hinges 190*a*. A locking mechanism is provided on the panel 180*a*. The locking mechanism includes a stationary mounting block 170*a* that is securely mounted to the panel 180*a*, and a pivoting bar 172*a* pivotably secured to the front of the block 170*a*. The depth of the block 170*a* is dimensioned so that it is slightly larger than the width of the rear panels 132*a*, so as to allow the bar 172*a* to snugly overlie the outsides of the front panels 134*a* after they have been folded towards each other in the collapsed position.

Figure 15:
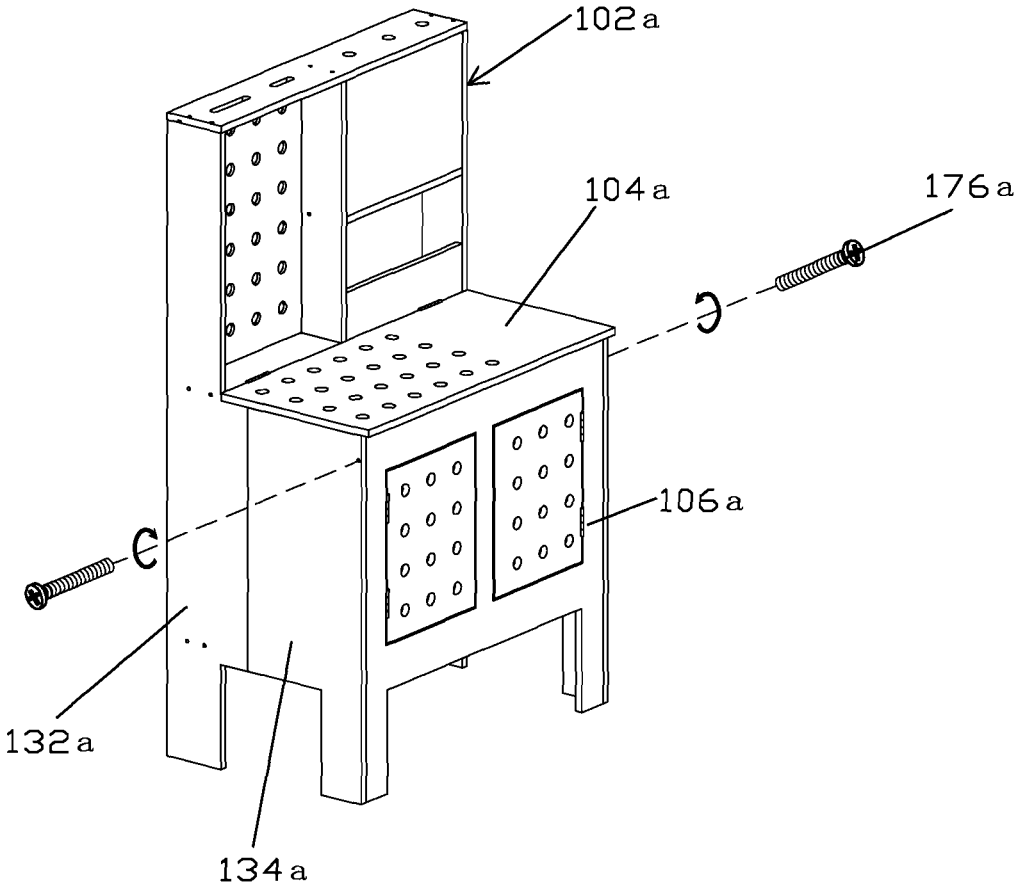

In addition, referring to FIG. 15, the front panels 134*a* can be secured to the front wall 106*a* via threaded connections by the use of screws 176*a*.

Figure 11:
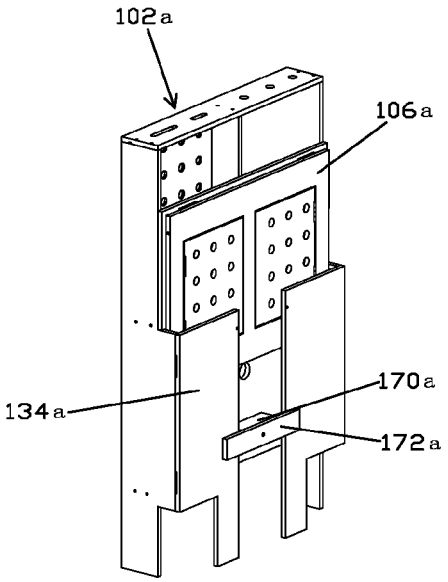
FIG. 11 shows the workbench of FIG. 9 in the fully collapsed position.
Figure 12A:
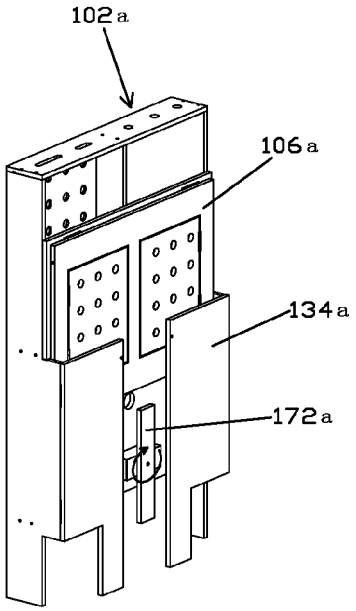
FIGS. 12A, 13, 14A and 15 illustrate the steps for deploying the workbench of FIG. 11 into a fully expanded position for use.
Figure 12B:
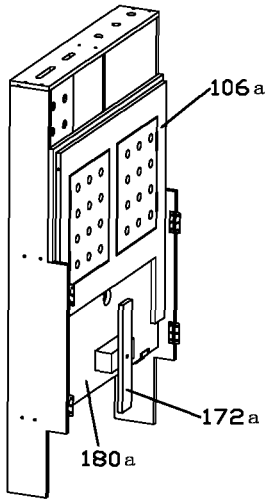
FIG. 12B illustrates the same workbench of FIG. 12A but with some of the components removed.

FIGS. 9-15 illustrate how the workbench 100*a* can be collapsed and deployed. Starting with FIG. 9, the workbench 100*a* is shown in the fully deployed position. In FIG. 15, the screws 176*a* can be removed, and then the front panels 134*a* can be pivoted away from each other, so as to allow the front wall 106*a* to be pushed upwardly about the pivoting connections (i) defined by the hinges 178*a* between the upper edge 162*a* of the front wall 106*a* and the underside of the counter top 104*a*, (ii) defined by the hinges 158*a* between the counter top 104*a* and the panel 120*a*, (iii) defined by the hinges 190*a* between the front edge of the panel 180*a* and the front wall 106*a*, and (iv) defined by the hinges 184*a* between the rear edge of the panel 180*a* and the front edge of the panel 182*a*. See FIGS. 13 and 14A-14B. This allows the counter top 104*a* to be pushed against the back board 102*a*, and the front wall 106*a* to be pushed against the underside of the counter top 104, with the panel 180*a* sandwiched between the front wall 106*a* and the lower back support 130*a*, and positioned below the counter top 104. Referring to FIG. 12, the front panels 134*a* can then be pivoted towards each other, and when the front panels 134*a* are resting against the front wall 106*a*, the bar 172*a* can be rotated by ninety degrees so that its opposite ends are resting against the front panels 134*a* to secure the entire assembly in a collapsed and secure arrangement as shown in FIG. 11.

The workbench 100*a* can be opened up and deployed by reversing the steps shown in FIGS. 11-15, by following the sequence of steps shown in FIGS. 11-15. First, the bar 172*a* is rotated by ninety degrees to free the front panels 134*a* (FIG. 12), which are then pivoted away from each other (FIG. 13). The front wall 106*a* is then pulled down so that the counter top 104*a* is deployed. The front panels 134*a* are then secured to the front wall 106*a* via the screws 176*a* (FIG. 15) and the workbench 100*a* is ready for use.

The collapsible kitchen 100 and workbench 100*a* may be made of various materials. For example, the back supports 102, 102*a*, the counter 104, the counter top 104*a*, the front walls 106, 106*a*, the panels 132, 132*a*, 134, 134*a*, 180, 180*a* and the various panels and walls 114, 116, 120, 122, 124, 126, 114*a*, 116*a*, 120*a*, 122*a*, 124*a* and 126*a* may be mostly made of medium density fiberboard or other wood. The faucet 113, the sink 154 and the range 154 may be made of plastic. The doors 128, 160 and 160*a* can be made of fiberboard, wood, or plastic. Other materials may be alternatively or additionally be used for the aforementioned parts and other parts of any of the embodiments herein.

Thus, the present invention provides a collapsible toy workbench and kitchen which can provided in a "life-like" size for use by a child, yet can be quickly folded and collapsed for storage. The block 170, 170*a* and locking bar 172, 172*a* provide a simple and convenient locking mechanism for holding the collapsed workbench or kitchen together.

The above detailed description is for the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices, components, mechanisms and methods are omitted so as to not obscure the description of the present invention with unnecessary detail.

For example, the design of the kitchen counter 104 and counter top 104*a* can be varied by adding additional elements or making them simpler. The design and configuration of the storage spaces and doors in the back support 102, 102*a* can also be varied.

What is claimed is:

1. A collapsible toy structure comprising:

a back support having a left edge and a right edge;

a counter top pivotably connected to the back support such that the counter top is pivotable to an upright position, the counter top having a front edge and an underside;

a front wall that is pivotably connected to the underside of the counter top at a location offset from the front edge;

a left side wall having a left rear panel and a left front panel, the left rear panel having a rear edge that is secured to the left edge of the back support, and a front edge that is pivotably connected to the left front panel;

a right side wall having a right rear panel and a right front panel, the right rear panel having a rear edge that is secured to the right edge of the back support, and a front edge that is pivotably connected to the right front panel;

a locking mechanism having a block coupled to the back support and a locking bar rotatably connected to the block, the locking bar having opposite ends; and wherein the toy structure assumes a collapsed position with the counter top pivoted to an upright position against the back support, the front wall pivoted to an upright position against the counter top, the left front panel and the right front panel pivoted against the front wall, and with the locking bar rotated to a position where its opposite ends are positioned against the left front panel and the right front panel.

2. The toy structure of claim 1, wherein the toy structure is a kitchen, and the counter top includes a sink, a range, and a faucet.

3. The toy structure of claim 1, wherein the toy structure is a workbench.

4. The toy structure of claim 1, wherein the back support includes a plurality of storage spaces defined by dividing panels and walls.

5. The toy structure of claim 1, further including a horizontal panel having a front edge pivotably coupled to the front wall, and a rear edge pivotably coupled to the back support, and wherein the block is provided on the horizontal panel.

6. A method of folding and locking a collapsible toy structure for storage, comprising the steps of:

(a) providing a toy structure comprising:

a back support having a left edge and a right edge;

a counter top pivotably connected to the back support such that the counter top is pivotable to an upright position, the counter top having a front edge and an underside;

a front wall that is pivotably connected to the underside of the counter top at a location offset from the front edge;

a left side wall having a left rear panel and a left front panel, the left rear panel having a rear edge that is secured to the left edge of the back support, and a front edge that is pivotably connected to the left front panel;

a right side wall having a right rear panel and a right front panel, the right rear panel having a rear edge that is secured to the right edge of the back support, and a front edge that is pivotably connected to the right front panel; and a locking mechanism having a block coupled to the back support and a locking bar rotatably connected to the block, the locking bar having opposite ends; and (b) pushing the front wall towards the back support, thereby causing the counter top to pivot to an upright position against the back support, with the front wall being pivoted to an upright position against the counter top;

(c) pivoting the left front panel and the right front panel against the front wall; and (d) rotating the locking bar to a position where its opposite ends are positioned against the left front panel and the right front panel.

* * * * *